US006315251B1

(12) United States Patent
Stoudt et al.

(10) Patent No.: US 6,315,251 B1
(45) Date of Patent: Nov. 13, 2001

(54) PORTABLE SIGN STAND

(75) Inventors: David A. Stoudt, Clackamas; Dennis L. Marcotte, Durham, both of OR (US)

(73) Assignee: Custom Stamping & Mfg. Co., Portland, OR (US)

( * ) Notice: Subject to any disclaimer, the term of this patent is extended or adjusted under 35 U.S.C. 154(b) by 0 days.

(21) Appl. No.: 09/497,831

(22) Filed: Feb. 3, 2000

(51) Int. Cl.[7] ..... A45F 3/44

(52) U.S. Cl. ..... 248/156; 248/622; 248/160; 248/170; 40/608

(58) Field of Search ..... 248/622, 623, 248/624, 625, 618, 469, 160, 170; 40/608, 607

(56) References Cited

U.S. PATENT DOCUMENTS

| | | | | |
|---|---|---|---|---|
| 1,269,212 | | 6/1918 | Poole . | |
| 1,487,635 | | 3/1924 | Watts . | |
| 1,903,683 | | 4/1933 | Nute . | |
| 2,141,067 | * | 12/1938 | Miller | 40/612 |
| 3,124,329 | | 3/1964 | Ransom et al. . | |
| 4,038,769 | | 8/1977 | Werner . | |
| 4,137,662 | * | 2/1979 | Baumer | 40/612 |
| 4,183,695 | * | 1/1980 | Wilcox | 404/6 |
| 4,565,466 | * | 1/1986 | Daggs | 404/10 |
| 4,676,015 | | 6/1987 | Stoudt . | |
| 4,888,894 | * | 12/1989 | Brown, Jr. | 40/606 |
| 4,951,407 | * | 8/1990 | Werner | 40/608 |
| 5,489,077 | | 2/1996 | Stoudt . | |
| 5,624,210 | | 4/1997 | Baldwin et al. . | |
| 5,732,911 | * | 3/1998 | Kulp et al. | 248/158 |

OTHER PUBLICATIONS

Little Buster™ brochure by TrafFix Devices, Inc., Jan. 1997.
Work–Site Signage Catalog, MDI® Traffic Control Products, date unknown.
DYNAFLEX brochure, Dicke Tool Company, 1985.
Quadra Flex V™ brochure, date unknown.
Power Cell® One Piece PC Models brochure, Sign Up Corporation, date unknown.
Power Cell® Two Piece PC Models brochure, Sign Up Corporation, date unknown.
Mini–Stand® Series MS–2000X brochure, Sign Up Corporation, date unknown.
Traffic Alert Products for Safety and Savings brochure, Sign Up Corporation, date unknown.

* cited by examiner

*Primary Examiner*—Anita King
*Assistant Examiner*—Kimberly Wood
(74) *Attorney, Agent, or Firm*—Kolisch, Hartwell Dickinson, McCormack & Heuser

(57) ABSTRACT

A portable sign stand comprising a base, at least one leg attached to the base at at least one attachment point, and a sign supporting member pivotally mounted to the base at a pivot point. The pivot point is disposed at a lower position on the base than all of the attachment points.

16 Claims, 3 Drawing Sheets

PORTABLE SIGN STAND

BACKGROUND OF THE INVENTION

The present invention relates to a portable sign stand with a pivoting sign support mechanism that increases the stability of the stand when the stand is subjected to loads such as wind pressure or vehicular contact.

Highway safety signs are often displayed on portable sign stands in the vicinity of temporary highway conditions, such as construction activity or road damage, to notify drivers of the upcoming danger. Portable highway safety sign stands are generally designed to be lightweight, sturdy and collapsible so that they may be quickly set up or taken down, readily moved, and easily stored when not in use. The stands generally include a base supported on collapsible legs, and a sign support member extending upward from the base for displaying a sign. When used on a road with fastmoving traffic, the stands may be subjected to heavy wind loads produced by passing traffic, and may also be run over by passing vehicles or construction equipment. A number of mechanisms have been developed to prevent the signs from being toppled or damaged by such forces and to protect from injury the drivers of vehicles that run over the stands. Generally, the mechanisms function by providing a location at which the sign stand may flex or pivot in response to the application of a force, in combination with some means for returning the sign to a vertical position after the force is removed. The most common mechanisms involve the use of a flexible member or pivotal joint disposed at some point between the base and a sign supported on the sign support member, coupled with a spring for returning the sign support member to its vertical position.

Portable sign stands for displaying highway safety signs are generally designed with safety, stability and durability as primary goals. First, the sign stands should be designed to be as safe as possible for both users and occupants of passing vehicles. For instance, the springs used to tension the sign support member in a vertical position are often very stiff. The flexing of these springs may open up pinch points that may injure an unwary user when the spring returns to its neutral position. Thus, the spring should be designed to protect users from this type of injury. More importantly, if a vehicle strikes a stand, the stand may cause injury to the occupants of the vehicle or damage to the vehicle. For instance, if the vehicle hits the stand with enough speed, the stand may come over the hood of the vehicle and strike the windshield. Thus, these stands should be designed to withstand an impact from a vehicle, yet minimize the potential of injury to the occupants of the vehicle.

Stability is another important concern for portable highway safety sign stands, as the stands should resist being blown over by wind from passing vehicles. When a sign stand is subjected to a wind load, moments are created about the points where each leg of the stand meets the ground. In a heavy wind, these moments may be large enough to topple a sign over its legs. One way to reduce these moments is to lengthen the legs of a stand. However, this reduces the portability and storability of the stand. Thus, another method of increasing the stability of a sign stand would be desirable.

Finally, the portable stands should be designed to be as durable as possible. The pivoting mechanisms of the sign stands must be strong enough to withstand the constant pivoting caused by heavy traffic conditions. The springs used in these mechanisms are particularly susceptible to stress and strain. Over time, these springs may fail and require replacement, which may be expensive.

The life of a spring in a stand is related to the type of stresses to which the spring is subjected. For instance, many stands utilize bending mechanisms, in which a spring is tensioned by bending when the sign support member pivots, to return the sign to a vertical position. One type of bending mechanism incorporates a vertical leaf spring into the sign support member. The leaf spring may bend when a sign on the stand is subjected to a load, dispersing the force from the load. However, this type of stand has the disadvantage that the spring may be damaged if a vehicle runs over the stand, as the leaf spring may not be able to bend sufficiently for a sign mounted to the stand to fit beneath the vehicle without damaging the spring.

Another type of bending mechanism uses a coil spring attached in an upright position to a base, with a sign support member mounted to the top of the spring. An example of this type of sign stand is disclosed in U.S. Pat. No. 4,038,769 to Werner. When this type of stand is bent, one side of the coil spring is compressed and the other side is stretched. It may be possible to bend these springs far enough to position a sign mounted to the stand parallel to the road surface, but such a severe deflection may damage the spring. Moreover, the unequal stresses caused by this type of spring motion may lead to the premature fatigue or failure of the spring.

In both of the configurations described above, the spring serves the dual function of supporting the sign and resisting deflection. A third type of sign stand uses a coil compression spring mounted between the sign stand base and the sign supporting member in such a way that the spring does not directly support the sign, but only functions to resist deflection. An example of this type of sign stand is described in U.S. Pat. No. 4,676,015 to Stoudt. Stoudt discloses a sign stand that utilizes an off-center pivot mechanism with a compression spring disposed midway up the sign support post. This stand has the advantage that the spring is compressed rather than bent, which may extend the life of the spring. However, the pivoting mechanism of this stand is positioned high on the sign support member, so that the sign stand may cause damage to a vehicle, or may itself be damaged, if struck. Furthermore, the stand is designed such that the pivot points would still be relatively high off of the base even if the pivoting mechanism were mounted to the base. Also, the off-center pivot mechanism of Stoudt has exposed pinch points where the top of the sign support member rests on the pivot mechanism that may injure an unwary user.

Thus, there remains a need for a durable and highly stable portable sign stand that provides safety features for the protection of both users and occupants of passing vehicles.

SUMMARY OF THE INVENTION

One aspect of the present invention provides a portable sign stand comprising a base, at least one leg attached to the base at at least one attachment point, and a sign supporting member pivotally mounted to the base at a pivot point. The pivot point is disposed at a lower position on the base than all of the attachment points.

Another aspect of the present invention provides a portable sign stand comprising a base, at least one pivot bar attached to the base, a vertically oriented sign support member pivotally engaged with at least one of the pivot bars, an anchor member attached to the base, and a spring engaged with the anchor member and the sign support member.

Yet another aspect of the invention provides a portable sign stand, comprising a base and a vertically oriented sign support member with a centrally disposed longitudinal axis. The base includes a bottom, two spaced upright sides attached to the bottom, at least one leg collapsibly attached to the base at at least one attachment point, two pivot bars disposed between the two upright sides at lower positions than all of the attachment points, and an anchor bar disposed between the two upright sides. The sign support member includes a vertical sign mounting member, a spring frame with two sets of notches for engaging the two pivot bars attached to one end of the vertical sign mounting member, a compression plate with an aperture disposed within the spring frame, an elongate rod with opposing ends extending through the aperture in the compression plate wherein one end of the elongate rod is attached to the anchor bar and the other end has an anchor seat attached, and a spring disposed around the elongate rod and positioned within the spring frame between the compression plate and the anchor seat. The anchor bar is attached to the base at a location along the longitudinal axis of the sign support member, and the pivot bars are attached to the base off of the longitudinal axis of the sign support member and on opposite sides of the longitudinal axis of the sign support member, so that pivoting the support member on either pivot bar causes the spring to be compressed between the compression plate and the anchor seat.

DETAILED DESCRIPTION OF THE PREFERRED EMBODIMENTS

Figure 1:
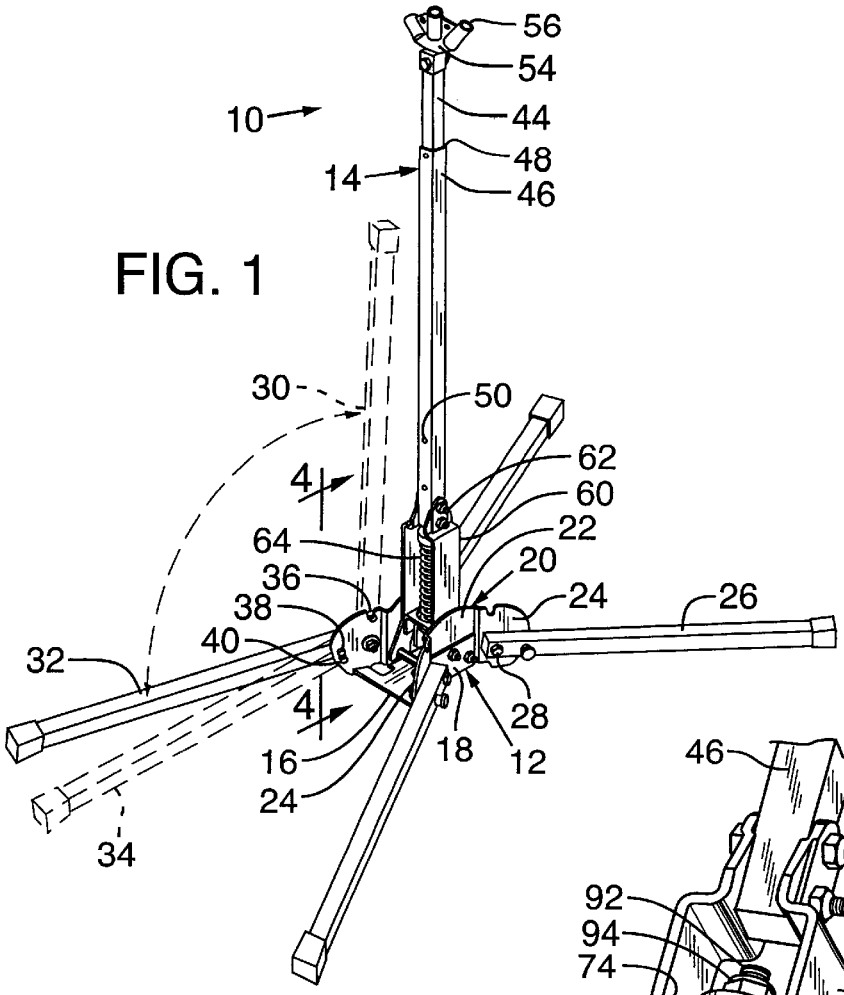
FIG. 1 is a perspective view of a first embodiment of the present invention.

The present invention provides a portable sign stand that utilizes a novel base with an off-center pivoting mechanism that enhances the safety and stability of the stand. FIG. 1 shows generally at 10 a sign stand according to a preferred embodiment of the present invention. Sign stand 10 includes a base 12, and a vertically oriented sign support member 14 pivotally mounted to base 12 for displaying a safety sign and warning flags. The pivoting mechanism, described in more detail below, utilizes a compression spring to return sign support member 14 to a vertical position when sign support member 14 is deflected by a force such as a gust of wind or vehicular contact. Base 12 includes a bottom member 16 onto which other components of base 12 are attached. When sign stand 10 is deployed, bottom member 16 is disposed parallel to the ground and perpendicular to sign support member 14 when sign support member 14 is in its vertical position. Bottom member 16 includes two vertically oriented wings 18 that extend upward from opposite sides of bottom member 16.

Each vertically oriented wing 18 supports one of two side pieces 20. Side pieces 20 are attached to the inside faces of vertically oriented wings 18 by any suitable means, such as by welding, so that they are perpendicular to bottom member 16. Each side piece 20 has three regions: a central region 22, and two outer extensions 24 that extend away from each side of central region 22. Side pieces 20 are mounted to bottom member 16 so that the central regions 22 of side pieces 20 are parallel to each other. Extensions 24 are angled away from the plane of central regions 22, and provide a surface for mounting legs 26. One leg 26 is mounted to each extension 24, for a total of four legs 26. The angle at which extensions 24 extend from central regions 22 is chosen to optimize the positions of legs 26 for maximum stability. Typically, sign stand 10 needs the most stability along the direction perpendicular to the face of a sign mounted on the stand, because the stand is subject to the greatest forces from winds hitting the sign along this direction. Thus, each leg generally is angled less than 45 degrees from this direction. Sign stand 10 is constructed of a material that may withstand severe impacts from vehicles, constant stress from normal operating conditions such as high wind gusts, and resist corrosion and oxidation. Steel is a preferred material. Bottom member 16 and side pieces 20 are typically constructed from sheet steel, and legs 26 from tubular steel. These parts may be coated with a suitable coating, such as an electrostatic polyester coating, to further protect the stand from oxidation and weathering.

Each leg 26 is attached to base 12 at an attachment point 28. Legs 26 are attached to base 12 with a suitable fastener that allows legs 26 to be pivoted between a plurality of set positions about attachment points 28. A preferred fastener is a threaded bolt and nut. As shown in FIG. 1, each leg 26 has three positions, indicated at 30, 32, and 34. When legs 26 are in vertical position 30 extending upwardly from base 12 along sign support member 14, they minimize the storage space taken up by sign stand 10. Positions 32 and 34 are for supporting sign stand 10 when it is in use. Two support positions are provided so that the legs may be independently adjusted to compensate for uneven surfaces. While only two support positions 32 and 34 are shown in the embodiment of FIG. 1, a stand may have as few or as many support positions for each leg as desired.

Legs 26 are held in each position 30, 32 and 34 by a spring-loaded pin 42. Pin 42 extends through each leg 26 and into one of three locking apertures 36, 38 and 40, best seen in FIG. 2, which are either holes or notches formed in each extension 24. Each aperture corresponds to one leg position: aperture 36 corresponds to position 30, aperture 38 to position 32, and aperture 40 to position 34. To move a leg 26 between positions, pin 42 is first pulled outward until it is free of the aperture corresponding to the current position of leg 26. Leg 26 may then be moved to a new position. When leg 26 reaches the new position, pin 42 automatically springs through the aperture corresponding to that position, locking leg 26 in the new position. While spring-loaded pin 42 is a preferred mechanism for locking a leg 26 in a desired position, other suitable mechanisms may also be used.

Referring again to FIG. 1, sign support member 14 extends vertically upward from base 12 and is configured for mounting safety signs and warning flags. Though sign support member 14 may be made to be a particular height, the height of sign support member 14 is preferably adjustable. FIG. 1 shows one possible mechanism for providing height adjustment. Sign support member 14 includes an upper post 44 that extends into a lower post 46 to form a telescoping joint 48. Upper post 44 has a spring-loaded pin (not shown) that extends outwardly through holes 50 in the body of lower post 46. The position of upper post 44 may be changed by first pushing the spring-loaded pin inwardly to free it from one hole 50, then moving upper post 44 up or down as desired. The spring-loaded pin will then spring through the next hole 50 encountered, fixing upper post 44 in that position. Additional holes 50 or other suitable adjustment mechanisms, which should not be prone to slipping, may alternatively be used.

Sign support member 14 also includes a flag yoke 54 mounted to the top of upper post 44. Flag yoke 54 includes three flag holders 56 configured for holding warning flags above a sign mounted to sign support member 14. The various components of sign support member 14, and sign stand 10 in general, may be made from any material that can withstand impacts from vehicles and stresses from heavy wind loads. Suitable materials should also be resistant to oxidation so that water or salt spray from rain or passing cars does not damage the stand. Steel is an example of a preferred material.

Figure 2:
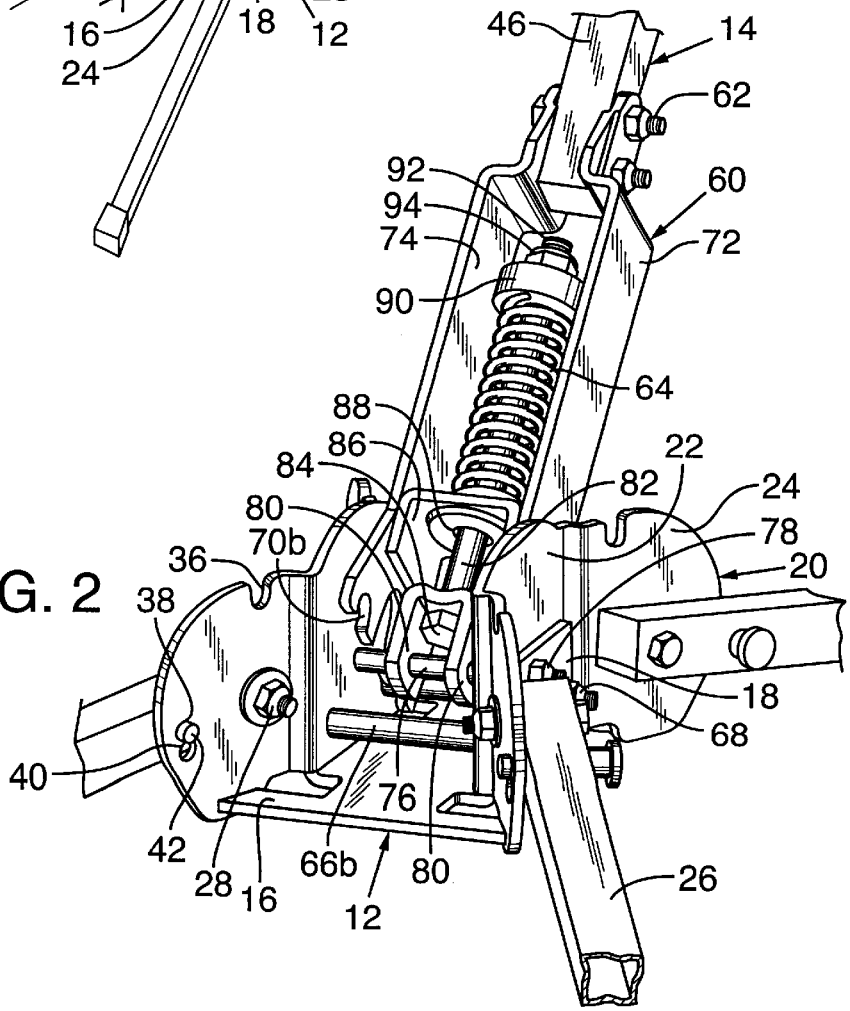
FIG. 2 is an enlarged perspective view of the base of the embodiment of FIG. 1, with the sign stand pivoted.
Figure 3:
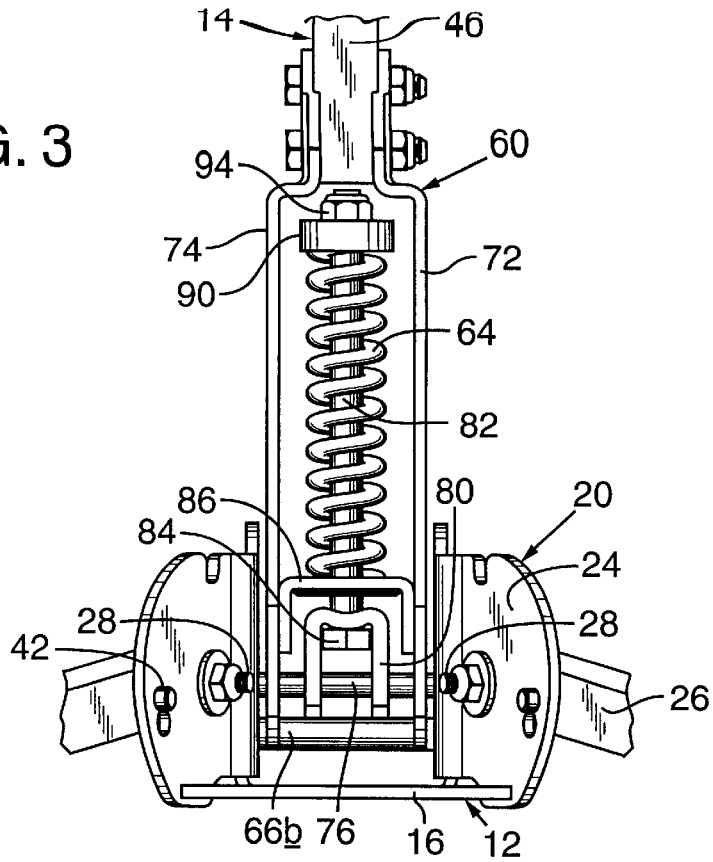
FIG. 3 is a frontal view of the base of the embodiment of FIG. 1, with the sign stand in an upright position.
Figure 4:
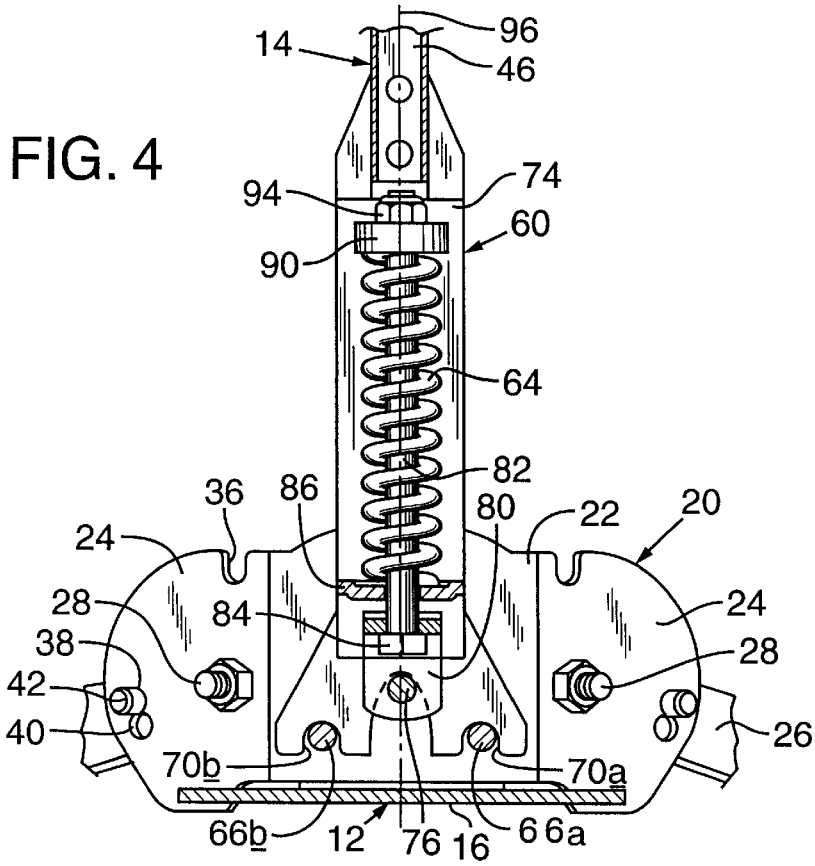
FIG. 4 is a partially sectioned side elevational view of the base of the embodiment of FIG. 1 taken along line 4—4 of FIG. 1, with the sign stand in an upright position.

A spring frame 60 that houses a compression spring 64 is attached to the bottom of sign support member 14 by bolts 62. FIGS. 2–4 show the construction of spring frame 60 and the pivotal coupling of spring frame 60 to base 12 in more detail. Base 12 includes two pivot bars 66*a* and 66*b*. Pivot bars 66*a* and 66*b* are disposed between side pieces 20 of base 12 so that each pivot bar 66*a* and 66*b* is at a vertically lower position on base 12 than attachment points 28. Though pivot bars 66*a* and 66*b* may be attached to side pieces 20 in any suitable manner, pivot bars 66*a* and 66*b* are preferably threaded bolts that are each mounted to base 12 with a nut 68.

The placement of pivot bars 66*a* and 66*b* at vertically lower points than attachment points 28 offers substantial benefits over prior sign stands. First, the stability of sign stand 10 is increased. When a strong wind pushes against a sign mounted to any portable sign stand, the moments that are created about the points where the legs of the stand contact the ground may be great enough to topple the stand over its legs. Lowering the position of the pivot points decreases these moments, and thus increases the stability of the stand. Furthermore, the pivot mechanism often adds significant mass to the sign support member. Lowering the pivot point lowers the center of mass of the entire stand, further increasing the stability of the stand.

Second, positioning the pivot points below the attachment points of the legs enhances the safety of stand 10. Portable sign stands often place the pivot point either above or at the same level as the attachment point of the legs. This may position the pivot point close to, or even above, the bumper line of many cars. If a moving vehicle strikes such a stand below the pivot point of the stand, several things may happen. First, the stand may be broken at the point of contact, requiring replacement. Second, the stand may damage the underside of the vehicle if it is forced beneath the vehicle. Third, the stand may come over the hood of the vehicle and injure the occupants of the vehicle. Thus, in the depicted embodiment, to protect the occupants of passing vehicles the stand pivots at a location lower than the point of contact with the vehicle so that the sign may fold down beneath the vehicle as the vehicle passes over it. The lower the pivot point is located, the more vehicles that the sign stand may pass safely beneath. Because sign stand 10 has pivot points located at a very low position on base 12, it may fit underneath vehicles with very low ground clearances. Sign support member 14 of sign stand 10 is designed so that it can pivot all the way to the ground. With sign support member 14 in this position, the highest points of sign stand 10 are the top edges of side pieces 20 of base 12. Thus, the depicted sign stand 10 offers considerable benefits over prior stands, as sign stand 10 can pass safely beneath any vehicle that can clear base 12.

The depicted embodiment also offers the advantage that even an extreme displacement of sign support member 14 will not damage spring 64. One known type of sign stand utilizes a coil spring that is bent when a sign mounted to the stand is displaced. It may be possible for these springs to bend far enough to fit underneath a car, but the spring may be damaged if bent this far. The preferred embodiment of the sign stand uses a compression mechanism rather than a bending mechanism for righting sign support member 14. Spring 64 is engaged with base 12 and sign support member 14 in such a way that it is compressed directly along its coil axis when sign support member 14 is displaced from a vertical position. Thus, spring 64 does not bend to either side when sign support member 14 is displaced. Furthermore, spring 64 is designed so that it may be fully compressed without being damaged, allowing spring 64 to withstand extreme displacements of sign support member 14.

Spring frame 60 is formed by two brackets 72 and 74, which are mounted on opposite sides of lower post 46 and enclose spring 64. Each bracket 72 and 74 includes two notches 70*a* and 70*b* formed in the lower edge of the brackets. These notches correspond to pivot bars 66*a* and 66*b*. FIG. 4 shows the position of these notches in bracket 74. When sign support member 14 is in its vertical position, spring frame 60 rests on pivot bars 66*a* and 66*b* so that pivot bars 66*a* and 66*b* fit within notches 70*a* and 70*b* respectively.

An anchor bar 76 is also attached to base 12 between side pieces 20 of base 12 in a position intermediate pivot bars 66*a* and 66*b*. Anchor bar 76 serves as an attachment point for anchoring the spring mechanism to base 12. Anchor bar 76 may be attached to base 12 in any suitable manner. In a preferred embodiment, anchor bar 76 is a threaded bolt that extends through both side pieces 20 and is held in place with a nut 78. Anchor bar also extends through both ends of a U-shaped anchor 80, which is disposed between side pieces 20. An elongate rod 82 is attached to U-shaped anchor 80, and extends upward from U-shaped anchor 80 between brackets 72 and 74. In the preferred embodiment, elongate rod 82 is a steel bolt that extends through U-shaped anchor 80 so that its head 84 remains held in U-shaped anchor 80. A compression plate 86 is also positioned between brackets 72 and 74. Compression plate 86 is attached to brackets 72 and 74 by any suitable means, such as welding, and has an aperture 88 through which elongate rod 82 passes. Spring 64 is positioned to be coiled around elongate rod 82 and sandwiched between compression plate 86 and an anchor seat 90. The upper end 92 of elongate rod 82 is threaded so that a nut 94 may be attached to hold anchor seat 90 against the upper end of spring 64. The tension in spring 64 may be adjusted by tightening or loosening nut 94 so that the stiffness of sign stand 10 may be adjusted for different wind conditions.

Sign stand 10 utilizes an off-center pivoting mechanism to transfer energy to compression spring 64 when sign support member 14 is deflected away from its vertical position. The off-center pivoting mechanism is so-named because it places the pivot points of sign support member 14 off of the vertical central axis of the sign stand. FIG. 4 shows a vertically disposed axis at 96 that defines the center of the vertical dimension of sign support member 14. Anchor bar 76 is attached to base 12 at a point along axis 96, and pivot bars 66*a* and 66*b* are attached to base 12 at points off of axis 96. In FIGS. 1–5, pivot bars 66*a* and 66*b* are shown positioned in mirror-image locations on opposite sides of axis 96, but they may be positioned in other locations, as long as brackets 72 and 74 include corresponding notches 70*a* and 70*b* in the correct positions.

Figure 5:
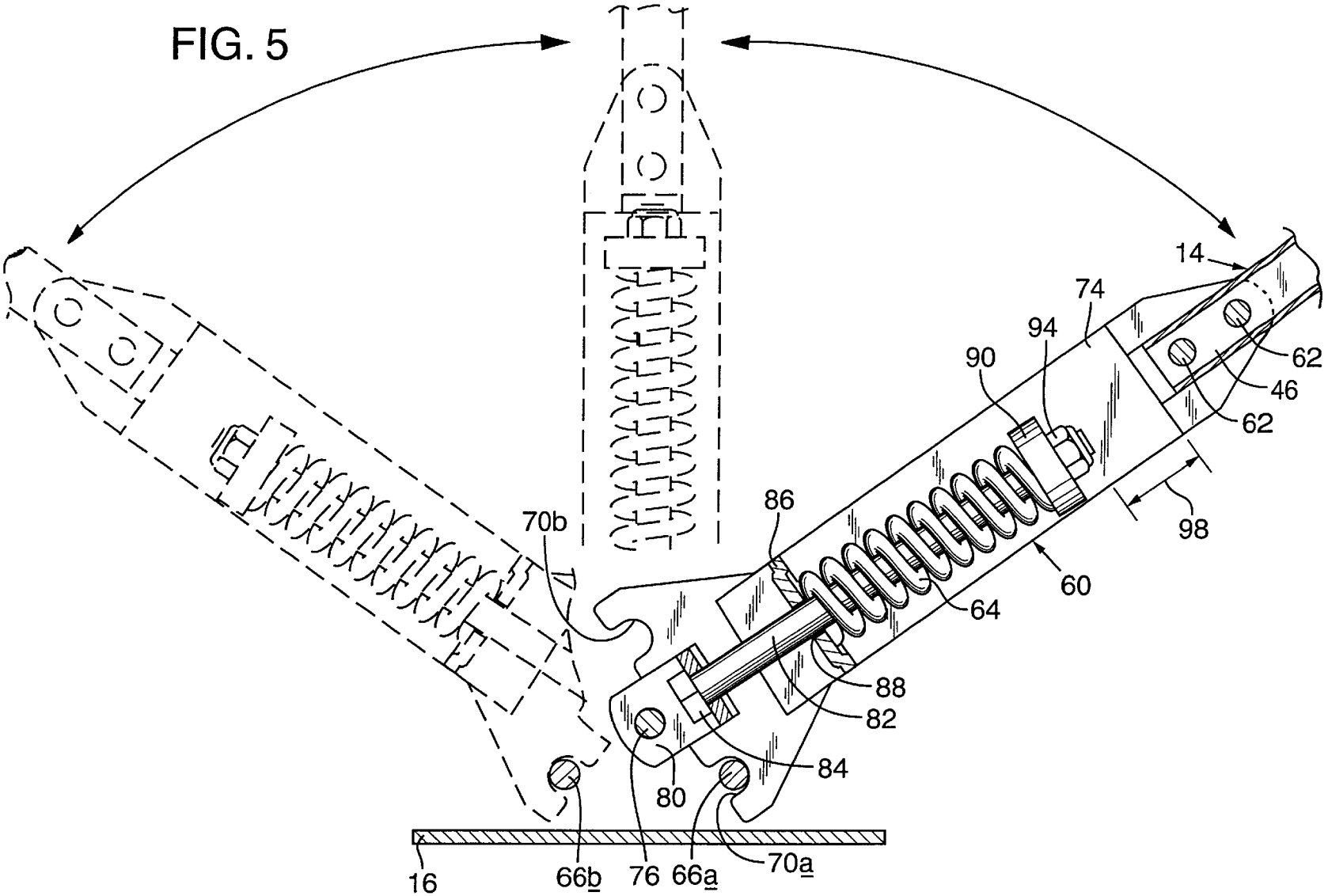
FIG. 5 a ponding to FIG. 4 except that the sign stand is shown in solid lines to be pivoted rightwardly with the spring in a compressed mode, shown in phantom lines as being upright with the spring in an uncompressed mode, and shown in phantom to be pivoted leftwardly with the spring in a compressed mode.

FIG. 5 shows a schematic representation demonstrating how spring 64 is compressed when sign support member 14 is pivoted away from its vertical position. The normal vertical resting position of sign support member 14 is shown in phantom in FIG. 5. In this position, notch 70*a* rests on pivot bar 66*a* and notch 70*b* rests on pivot bar 66*b*. When sign support member 14 is in this position, the upper end 92 of elongate rod 82 is positioned very close to the bottom of lower post 46. When sign support member 14 is subjected to a load, it may pivot to either side of its rest position. When sign support member 14 pivots to the right, as shown in solid lines in FIG. 5, it pivots only on pivot bar 66*a*. Notch 70*a* remains in contact with pivot bar 66*a*, but notch 70*b* disengages from pivot bar 66*b*. As sign support member 14 pivots, elongate rod 82, held by Ushaped anchor 80, is pulled through aperture 88 in compression plate 86. This causes anchor seat 90 to be pulled toward compression plate 86, as shown at 98, compressing spring 64 between anchor seat 90 and compression plate 86. When spring 64 expands, it pushes anchor seat 90 back toward lower post 46, causing sign support member 14 to return to its vertical position. Similarly, when sign support member is pivoted to the left, as shown in phantom in FIG. 5, it pivots at notch 70*b* on pivot bar 66*b*, while notch 70*a* separates from pivot bar 66*a*. Because pivot bars 66*a* and 66*b* are disposed between side pieces 20 of base 12, users of the stand are protected by side pieces 20 from the pinch points that are formed when notches 70*a* and 70*b* separate from pivot bars 60*a* and 60*b* during pivoting.

While the invention has been disclosed in its preferred form, the specific embodiments thereof as disclosed and illustrated herein are not to be considered in a limiting sense as numerous variations are possible. Applicants regard the subject matter of their invention to include all novel and non-obvious combinations and subcombinations of the various elements, features, functions and/or properties disclosed herein. No single feature, function, element or property of the disclosed embodiments is essential to all embodiments. The following claims define certain combinations and subcombinations which are regarded as novel and non-obvious. Other combinations and subcombinations of features, functions, elements and/or properties may be claimed through amendment of the present claims or presentation of new claims in this or a related application. Such claims, whether they are different, broader, narrower or equal in scope to the original claims, are also regarded as included within the subject matter of applicants' invention.

What is claimed is:

1. A portable sign stand, comprising:

a base including a bottom and two upright sides;

a first pivot bar and a second pivot bar extending between the two upright sides of the base;

at least one leg attached to the base;

a sign support member pivotally coupled to the first pivot bar and the second pivot bar, the sign support member having a centrally disposed longitudinal axis, and the first pivot bar and the second pivot bar being positioned off of the centrally disposed longitudinal axis and in opposing relation relative to one another such that the sign support member pivots on only one pivot bar at a time; and a biasing member configured to return the sign support member to a vertical position when the sign support member is pivoted.

2. The sign stand of claim 1, wherein the biasing member is a spring coupled to the base and the sign support member to return the sign support member to a vertical position when the sign support member is pivoted.

3. The sign stand of claim 2 wherein the base includes an anchor bar extending between the two sides of the base at a location along the longitudinal axis of the sign support member, the sign stand further comprising an elongate rod coupled to the anchor bar, the elongate rod having a top plate configured to compress the spring when the sign support member is pivoted.

4. The sign stand of claim 3, the sign support member having an upper end and a lower end, wherein a frame is attached to the lower end of the sign support member for at least partially containing the spring.

5. The sign stand of claim 4, wherein the frame includes a compression plate, the spring being compressed between the compression plate and the top plate when the sign support member is pivoted on the base.

6. The sign stand of claim 5, wherein the compression plate includes an aperture through which the elongate rod extends, and wherein the spring is positioned within the frame between the compression plate and the top plate.

7. The sign stand of claim 1, wherein at least one of the legs is collapsibly attached to the base.

8. A portable sign stand, comprising:

a base having a bottom and two sides;

a plurality of pivot bars extending between the two sides of the base;

a vertically oriented sign support member pivotally engaged with the pivot bars, the sign support member including a centrally disposed longitudinal axis and being configured to pivot on only one pivot bar when pivoted in a selected direction and to lift off of the other of the plurality of pivot bars when pivoted in the selected direction;

an anchor extending between the two sides of the base;

an elongate rod coupled to the anchor, the rod having a top plate; and a spring configured to be compressed by the top plate of the rod to return the sign support member to a vertically oriented position after pivoting.

9. The sign stand of claim 16, wherein two pivot bars extend between the sides of the base, and wherein the pivot bars are positioned off of the longitudinal axis of the sign support member and on opposite sides of the longitudinal axis of the sign support member.

10. The sign stand of claim 8, the sign support member having a top end and a bottom end, wherein the sign support member includes a frame attached to the bottom end for at least partially enclosing the spring.

11. The sign stand of claim 10, further comprising a compression plate disposed within the frame for compressing the spring between the compression plate and the top plate when the sign support member is pivoted on the base.

12. The sign stand of claim 11, wherein the compression plate includes an aperture through which the elongate rod extends, and wherein the spring is disposed around the elongate rod and positioned within the frame between the compression plate and the top plate.

13. The sign stand of claim 8, further comprising at least one leg attached to the base at an attachment point.

14. The sign stand of claim 13, wherein at least one of the pivot bars is disposed on the base in a lower position than the attachment point.

15. The sign stand of claim 13 wherein at least one of the legs is collapsibly attached to the base.

16. A portable sign stand, comprising:

a base, including a bottom, two spaced upright sides attached to the bottom, at least one leg collapsibly attached to the base at at least one attachment point, two pivot bars disposed between the two upright sides at lower positions than all of the attachment points, and an anchor bar disposed between the two upright sides; and a vertically oriented sign support member with a longitudinal axis, including a vertical sign mounting member, a spring frame attached to one end of the vertical sign mounting member, the spring frame including two sets of notches for engaging the two pivot bars, a compression plate disposed within the spring frame, the compression plate including an aperture, an elongate rod with opposing ends extending through the aperture in the compression plate, wherein one end of the elongate rod is attached to the anchor bar, and wherein the other end of the elongate rod has an anchor seat attached, and a spring disposed around the elongate rod and positioned within the spring frame between the compression plate and the anchor seat, wherein the anchor bar is attached to the base at a location along the longitudinal axis of the sign support member, and wherein the pivot bars are attached to the base off of the longitudinal axis of the sign support member and on opposite sides of the longitudinal axis of the sign support member, so that pivoting the support member on either pivot bar causes the spring to be compressed between the compression plate and the anchor seat.

* * * * *